US008690519B2

(12) United States Patent
Aalburg et al.

(10) Patent No.: US 8,690,519 B2
(45) Date of Patent: Apr. 8, 2014

(54) WET GAS COMPRESSOR SYSTEMS

(75) Inventors: Christian Aalburg, Bavaria (DE); Alexander Simpson, Bavaria (DE); Vittorio Michelassi, Firenze (IT); Ismail Sezal, Bavaria (DE)

(73) Assignee: General Electric Company, Niskayuna, NY (US)

( * ) Notice: Subject to any disclaimer, the term of this patent is extended or adjusted under 35 U.S.C. 154(b) by 526 days.

(21) Appl. No.: 13/020,873

(22) Filed: Feb. 4, 2011

(65) Prior Publication Data

US 2012/0201660 A1 Aug. 9, 2012

(51) Int. Cl.
*F04D 27/00* (2006.01)

(52) U.S. Cl.
USPC ..... 415/1; 415/169.2; 415/182.1

(58) Field of Classification Search
USPC ..... 415/1, 169.1, 169.2, 169.3, 169.4, 415/182.1
See application file for complete search history.

(56) References Cited

U.S. PATENT DOCUMENTS

| | | | | |
|---|---|---|---|---|
| 4,336,820 | A * | 6/1982 | Jorgensen et al. | 137/100 |
| 6,273,674 | B1 | 8/2001 | Charron | |
| 2008/0145213 | A1* | 6/2008 | Moussa et al. | 415/182.1 |
| 2009/0165864 | A1* | 7/2009 | Bryan | 137/15.1 |
| 2010/0236724 | A1* | 9/2010 | Duesel et al. | 159/4.02 |

* cited by examiner

*Primary Examiner* — Edward Look
*Assistant Examiner* — William Grigos
(74) *Attorney, Agent, or Firm* — Andrew J. Caruso

(57) ABSTRACT

The present application provides for a wet gas compressor system. The wet gas compressor system may include a wet gas compressor with an inlet section. A variable cross-section nozzle may be positioned about the inlet section.

19 Claims, 5 Drawing Sheets

WET GAS COMPRESSOR SYSTEMS

TECHNICAL FIELD

The present application relates generally to wet gas compressor systems and more particularly relates to wet gas compressors with a variable cross-section flow conditioning nozzle therein so as to reduce erosion and other damage caused by liquid droplets in a wet gas.

BACKGROUND OF THE INVENTION

Natural gas and other types of liquid fuels may include a liquid component therein. Such "wet" gases may have a significant amount of liquid volume fraction, in conventional compressors, liquid droplets in such wet gases may cause erosion or embrittlement of the impellers and rotor unbalance resulting therefrom. Specifically, the negative interaction between the liquid droplets and the compressor surfaces, such as impellers, end wails, seals, etc., may be significant. Erosion is known to be essentially a function of the relative velocity of the droplets during impact onto the compressor surfaces, droplet mass size, as well as the impact angle. Erosion may lead to performance degradation, reliability issues, reduced compressor lifetime, and increased maintenance requirements.

Current wet gas compressors thus generally separate the liquid droplets from the gas stream so as to limit or at least localize the impact of erosion and other damage caused by the liquid droplets. These known liquid separation systems and techniques, however, tend to be somewhat complex and likewise may add further reliability and maintenance issues to the compressor as a whole.

There is thus a desire for improved wet gas compression systems and methods. Preferably, such systems and methods may minimize the impact of erosion and other damage caused by liquid droplets in a wet gas while avoiding the need for liquid-gas separators and the like.

SUMMARY OF THE INVENTION

The present application thus provides for a wet gas compressor system. The wet gas compressor system described herein may include a wet gas compressor with an inlet section. A variable cross-section nozzle may be positioned about the inlet section.

The present application further provides a method of flow conditioning a gas flow with a number of liquid droplets therein before entry into a compressor. The method may include the steps of flowing the gas flow in a converging section of decreasing cross-sectional area and flowing the gas flow in a diverging section of increasing cross-sectional area. The gas flow accelerates in the converging section and the diverging section such that the liquid droplets breakup from a first size to a second size. The method further includes the step of flowing the gas flow across a shock point such that the liquid droplets breakup to a third size.

The present application further provides for a wet gas compressor system. The wet gas compressor system may include a wet gas compressor with an inlet section and a number of stages. One or more convergent-divergent nozzles may be positioned about the inlet section or in-between the stages. A gas flow with a number of liquid droplets may pass therein. The liquid droplets may have a first size upstream of the convergent-divergent nozzles and a second size downstream of the convergent-divergent nozzles. The second size may be smaller than the first.

These and other features and improvements of the present application will become apparent to one of ordinary skill in the art upon review of the following detailed description when taken in conjunction with the several drawings and the appended claims.

DETAILED DESCRIPTION

Figure 1:
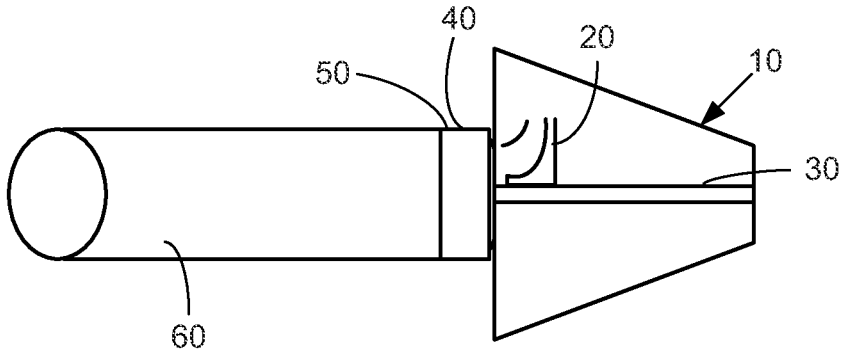
FIG. 1 is a schematic view of a known wet gas compressor with a portion of a pipe section.

Referring now to the drawings, in which like numbers refer to like elements throughout the several views, FIG. 1 shows an example of a known wet gas compressor 10. The wet gas compressor 10 may be of conventional design and may include a number of stages with a numbers of impellers 20 positioned on a shaft 30 for rotation therewith as well as a number of stators. The wet gas compressor 10 also may include an inlet section 40. The inlet section 40 may be an inlet scroll 50 and the like positioned about the impellers 20. Other types and configurations of wet gas compressors 10 may be known. A pipe section 60 may be in communication with the inlet section 40 of the wet gas compressor 10. The pipe section 60 may be of any desired size, shape, or length. Any number of pipe sections 60 may be used herein.

Figure 2:
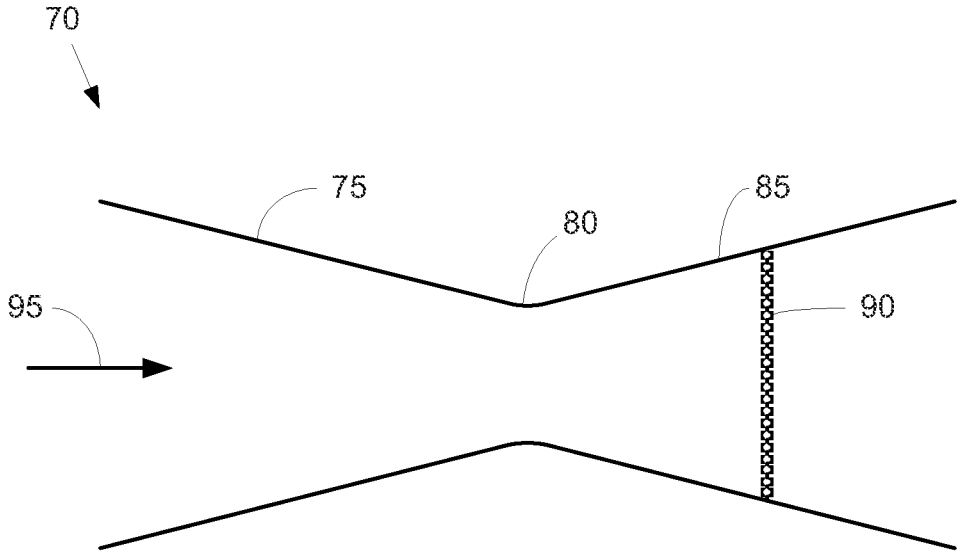
FIG. 2 is a schematic view of an example of a known variable cross-section nozzle.

FIG. 2 shows a known variable cross-section nozzle 70. The variable cross-section nozzle 70 may be a convergent-divergent nozzle also is known as a de Laval nozzle and the like. Generally described, the variable cross-section nozzle 70 may include a convergent section 75 with a decreasing cross-sectional area. The convergent section 75 may lead to a throat section 80 of essentially constant cross-sectional area. The throat section 80 generally has some length as opposed to being merely a point of smallest diameter. The throat section 80 in turn leads to a divergent section 85 of increasing cross-sectional area. A shock point 90 may be positioned within the divergent section 85 downstream of the throat section 80. The length of the sections 75, 80, 85 as well as the angle of increasing and decreasing cross-sectional areas may vary. The variable cross-section nozzle 70 includes a sequence of sections that provide flow acceleration and/or deceleration to promote a non-zero relative velocity between gaseous and liquid phases. The sections 75, 80, 85 may be symmetric or asymmetric. Other configurations may be used herein.

Generally described, a gas flow 95 enters the variable cross-section nozzle 70 about the convergent section 75. The speed of the gas flow 95 may be largely subsonic at this point. The speed of the gas flow 95 will increase in the decreasing cross-sectional area of the convergent section 75. The gas flow 95 then may expand and may increase to supersonic velocity in the divergent section 85 at about the shock point 90. The kinetic energy of the gas flow 95 leaving the variable cross-section nozzle 70 thus may be closely directed. Other types of variable cross-section nozzle designs may be known. For example, without the use of a throat section 80 of some length, the gas flow 95 may or may not increase to supersonic speeds and may or may not develop a shock point.

Figure 3:
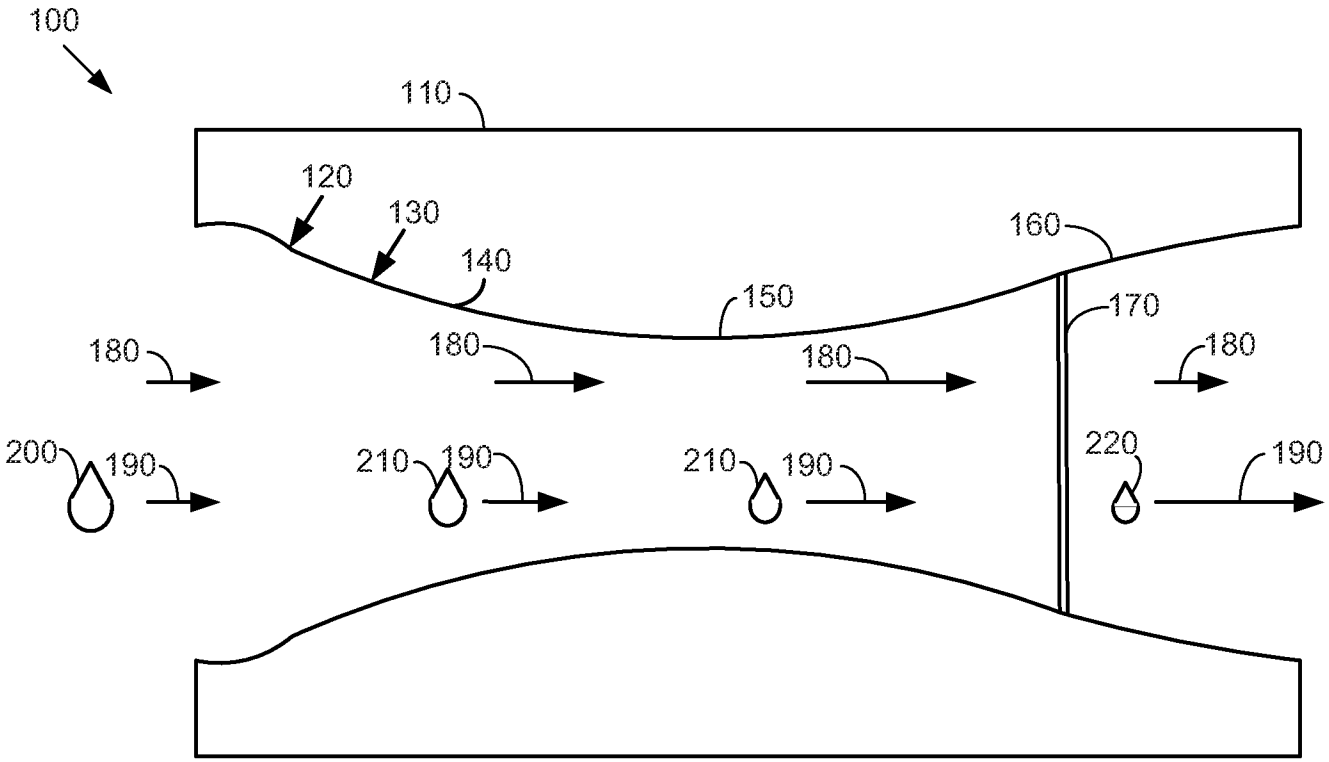
FIG. 3 is a schematic view of a flow conditioning nozzle as may be described herein.

FIG. 3 shows portions of a wet gas compressor system 100 as may be described herein. The wet gas compressor system 100 may include the wet gas compressor 10 described above or a similar type of compressor. Likewise, the wet gas compressor 10 may be in communication with the pipe section 60 or similar types of conduits.

The wet gas compressor system 100 may include an inlet section 110. The inlet section 110 may be positioned about the impellers 20 of the wet gas compressor 10. The inlet section 110 may include one or more flow conditioning nozzles 120 therein. The flow conditioning nozzle 120 may take the form of a convergent-divergent or a variable cross-section nozzle 130 similar to that described above. Specifically, the variable cross-section nozzle 130 may include some or all of a convergent section 140, a throat section 150, a divergent section 160, and a shock point 170. The relative sizes, lengths, and angles of the respective sections 140, 150, 160 may be varied. As above, the length of the sections 140, 150, 160 as well as the angle of increasing and decreasing cross-sectional areas may vary. The sections 140, 150, 160 may be symmetric or asymmetric. The variable cross-section nozzle 130 may be largely circular and axis-symmetric or quasi two-dimensional. Other configurations may be used herein. The flow conditioning nozzle 120 may be used with a gas flow 180 having a high liquid volume fraction due to a number of liquid droplets 190 therein.

Not all of the sections 140, 150, 160 must be used together herein. For example, the variable cross-section nozzle 130 need not include a throat section 150 of any length. The gas flow 180 thus may or may not reach supersonic speeds without such a throat section 150. In the subsonic case, no shock point 170 will develop downstream in the divergent section 160. Moreover, the variable cross-section nozzle 130 may be almost all just the convergent section 140.

The use of the flow conditioning nozzle 120 about the wet gas compressor 10 preferably may minimize the interaction between the liquid droplets 190 and the impellers 20 and the other surfaces of the wet gas compressor 10. Specifically, the flow conditioning nozzle 120 may provide secondary atomization of the liquid droplets 190 via the rapid changes in the velocity of the gas flow 180 due to the shape of the variable cross-section nozzle 130.

Specifically, the slip velocity between the gas flow 180 and the liquid droplets 190 may exceed critical values required for liquid droplet breakup. The size and design of the sections 140, 150, 160 of the variable cross-section nozzle 130 may control the rate of acceleration or deceleration therein as well as the shock strength so as to induce breakup as well as the type or mode of breakup. For example, bag-type breakup, shear-type breakup, and the like may be induced herein. As such, the divergent section 160 may have a relatively small angle so as to minimize the rate of gas acceleration and hence the slip velocity so as to prevent premature bag-type breakup and promote shear-type breakup downstream of the shock point 170. Bag-type breakup may reduce the size of the liquid droplets 190 by about 3.5 to 1 while shear-type breakup may reduce the size of the liquid droplets 190 by about 10 to 1. Other types of breakup modes may be used herein. For example, Multi-mode breakup (between bag and shear breakup) and catastrophic breakup also may be used.

The size of liquid droplets 190 tends to decrease as the cross-sectional area of the convergent section 140 decreases, i.e., positive slip. Likewise, the size of liquid droplets 190 may continue to decrease, although not as steeply, as the cross-sectional area of the divergent section 160 increases, i.e., again positive slip. A sharp decrease in the size of the liquid droplets 190 may be expected about the shock point 170, i.e., instantaneous slip reversal. The size of liquid droplets 190 may remain substantially constant thereafter, i.e., negative slip. Given such, the liquid droplets 190 may have a first size 200 entering the flow conditioning nozzle, a smaller or a number of smaller second sizes 210 passing through the convergent section 140, the throat 150, and entering into the divergent section 160, and a smaller third size 220 downstream of the shock point 170.

More than one breakup of the liquid droplets 190 may take place. For example, rapid acceleration of the gas flow 180 in the convergent section 140 may induce a first round breakup of the liquid droplets 190. A second round of breakup may be achieved by the rapid deceleration of the gas flow 180 as it passes through the shock point 170 and the diversion section 160. Each round of breakup may have the same or a different mode of breakup.

The gas flow 180 thus may be accelerated through one or more flow conditioning nozzles 120 such that the liquid droplets 190 therein breakup one or more times until the desired droplet size may be achieved. The flow conditioning nozzle 120 may be both subsonic and supersonic depending upon the amount of acceleration required for droplet breakup and how many breakup steps may be desired to achieve a specific drop size. For a subsonic nozzle, droplet breakup may be induced by flow acceleration therethrough. For supersonic nozzles, breakup also may be induced when the droplets pass through a single or series of normal or oblique shocks. The flow conditioning nozzle 120 also may be used with appropriately shaped guide vanes so as to induce a preswirl into the gas flow 180 so as to reduce the relative velocity between the impellers 20 and the liquid droplets 190.

By allowing the gas flow 180 to contain liquid droplets 190 therein, the liquid droplets 190 may provide intercooling of the gas flow 180 during compression as the gas flow 180 reaches the wet gas compressor 10. Specifically, reducing the size of the liquid droplets 190, as described above, thus may maximize the intercooling benefit. Likewise, promoting evaporation of the liquid droplets 190 in multistage compressors also may be enhanced by minimizing the size of the liquid droplets 190. Sufficiently small liquid droplets 190 may tend to follow the streamline of the gas flow 180 so as to reduce the overall interaction with the surfaces of the wet gas compressor 10. Specifically, smaller liquid droplets 190 may lead to more favorable impingement angles, reduced momentum during impact, and enhanced evaporation while maximizing intercooling and reducing liquid volume fractions.

The overall lifetime and reliability of the compressor 10 thus may be enhanced for a given amount of gas flow in terms of the liquid volume fraction. Moreover, the amount of liquid that a compressor 10 may tolerate under certain boundary conditions also may be increased without compromising overall lifetime and reliability. Significantly, the flow conditioning nozzle 120 provides these benefits without any moving parts.

The fluid conditioning nozzle 120 need not be a separate element. Rather, the shape of the variable cross-section nozzle 130 may be within an inlet scroll 50, within a pipe section 60, or by shaping any type of end wall such as a shroud wall, a hub wall, and the like. One large flow conditioning nozzle 120 may be used or a number of smaller nozzles may be arranged circumferentially within the inlet scroll 50, the pipe section 60, or otherwise.

Figure 4:
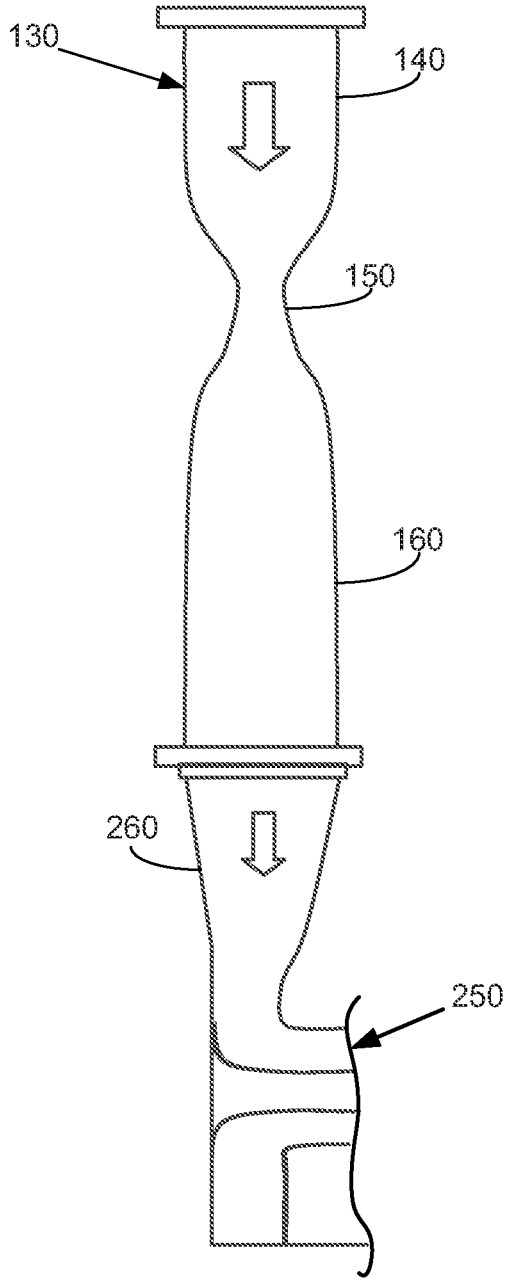
FIG. 4 is a partial schematic view of a variable cross-section nozzle as may be described herein positioned about a radial inlet of a wet gas compressor.
Figure 5:
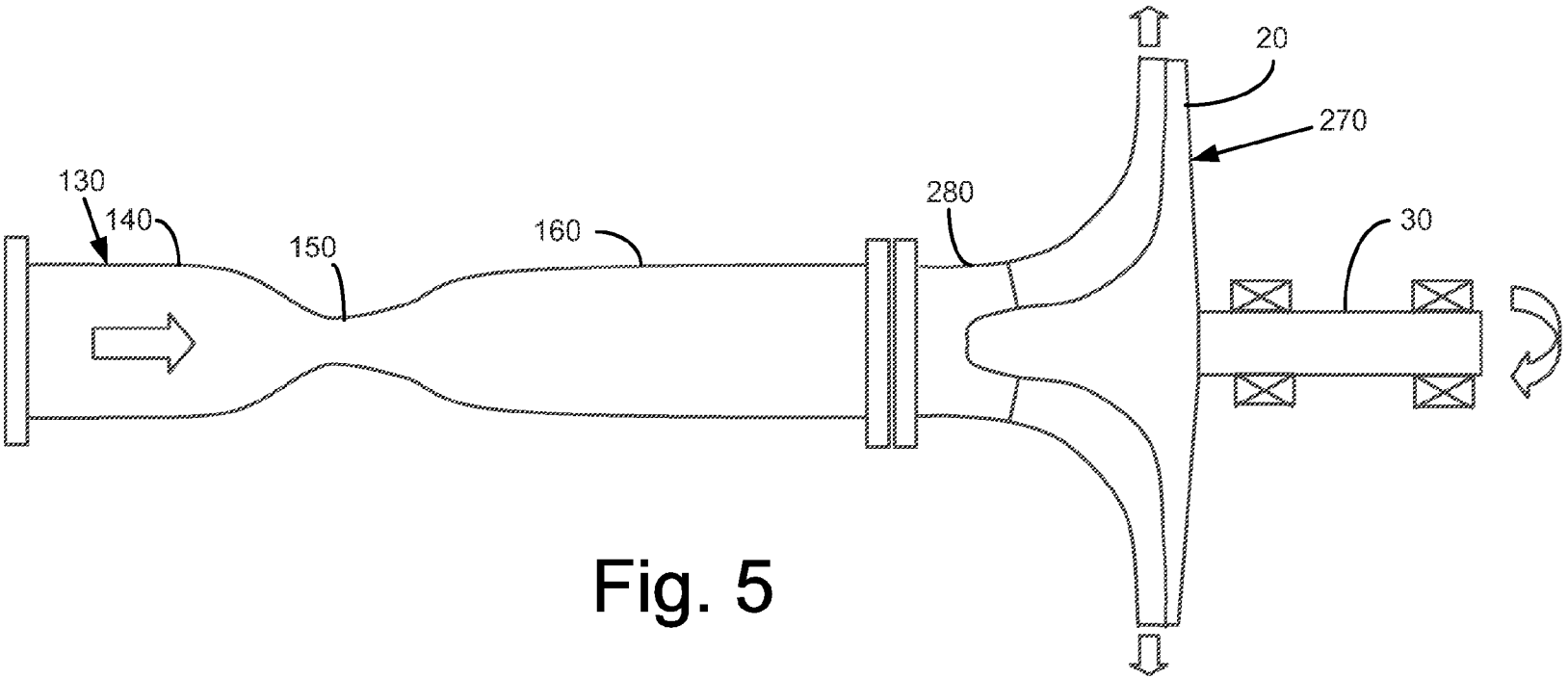
FIG. 5 is a partial schematic view of a variable cross-section nozzle as may be described herein positioned about a radial inlet of a wet gas compressor.

FIGS. 4 and 5 show the use of the variable cross-section nozzle 130 about wet gas compressors 10 having inlet sections 40 of varying configurations. For example, FIG. 4 shows a wet gas compressor 250 with a radial inlet section 260. The variable cross-section nozzle 130 thus may be positioned in a radial direction. Likewise, FIG. 5 shows a wet gas compressor 270 with an axial inlet section 280. The variable cross-section nozzle 130 thus may have an axial position. Other positions and other types of wet gas compressors may be used herein. For example, the variable cross-section nozzles 130 may be used with overhung compressors, beamed compressors, and the like. Other configurations may be used herein.

Figure 6A:
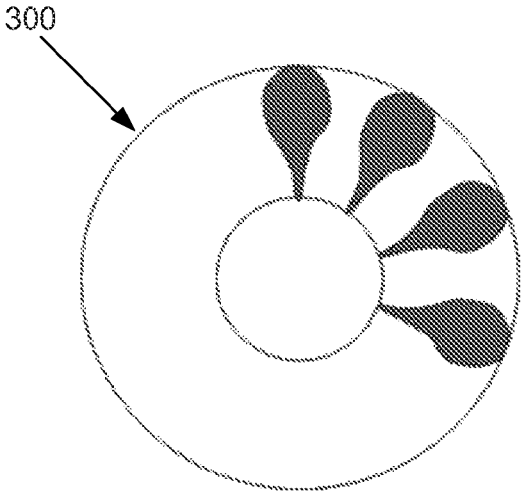
FIG. 6A is a plan view of a nozzle configuration as may be used herein.
Figure 6B:
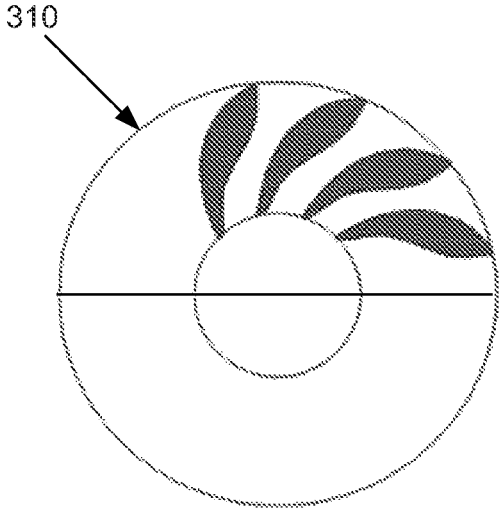
FIG. 6B is a plan view of a nozzle configuration as may be used herein.
Figure 7:
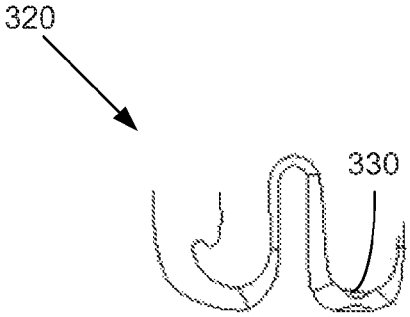
FIG. 7 is a partial schematic view of a variable section device positioned between consecutive stages.

FIGS. 6A and 6B show two possible nozzle configurations 300, 310 for use with the variable cross-section nozzle described herein. FIG. 7 shows a multi-stage arrangement 320 in which an additional converging section 330 may be applied between consecutive stages. The nozzle configurations 300 and 310 may be used also in conjunction with the radial inlet section 260 and the like.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A wet gas compressor system, comprising:
a wet gas compressor;
the wet gas compressor comprises an inlet section;
a plurality of impellers disposed downstream of the inlet section; and
a variable cross-section nozzle positioned upstream of the plurality of impellers and about the inlet section.

2. The wet gas compressor system of claim 1, wherein the inlet section comprises a radial inlet section or an axial inlet section.

3. The wet gas compressor system of claim 1, wherein the variable cross-section nozzle comprises a throat section.

4. The wet gas compressor system of claim 1, wherein the variable cross-section nozzle comprises a divergent section.

5. The wet gas compressor system of claim 4, wherein the divergent section comprises a shock point.

6. The wet gas compressor system of claim 1, further comprising a plurality of variable cross-section nozzles.

7. The wet gas compressor system of claim 1, wherein the inlet section comprises an inlet scroll.

8. The wet gas compressor system of claim 1, wherein the inlet section comprises a pipe section.

9. The wet gas compressor system of claim 1, further comprising a gas flow with a plurality of liquid droplets therein.

10. The wet gas compressor system of claim 9, wherein the gas flow comprises a subsonic speed.

11. The wet gas compressor system of claim 9, wherein the gas flow comprises a supersonic speed.

12. The wet gas compressor system of claim 9, wherein the plurality of liquid droplets comprises a first size upstream of the variable cross-section nozzle and a second size downstream of the variable cross-section nozzle and wherein the second size is smaller than the first size.

13. The wet gas compressor system of claim 1, wherein the variable cross-section nozzle is positioned between a plurality of stages.

14. A method of flow conditioning a gas flow with a plurality of liquid droplets therein, comprising:
flowing the gas flow in a converging section of decreasing cross-sectional area;
flowing the gas flow in a diverging section of increasing cross-sectional area;
wherein the gas flow accelerates in the converging section and the diverging section such that the plurality of liquid droplets break up from a first size to a second size;
flowing the gas flow across a shock point such that the plurality of liquid droplets break up to a third size; and
feeding the gas flow and the plurality of broken liquid droplets to a wet gas compressor.

15. The method of claim 14, wherein the second size is smaller than the first size and wherein the third size is smaller than the second size.

16. The method of claim 14, wherein the flowing steps comprise a subsonic velocity.

17. The method of claim 14, wherein the flowing steps comprise a supersonic velocity.

18. A wet gas compressor system, comprising:
a wet gas compressor;
the wet gas compressor comprises an inlet section and a plurality of stages;
a plurality of impellers disposed downstream of the inlet section;
one or more variable cross-section nozzles positioned upstream of the plurality of impellers and about the inlet section; and
a gas flow with a plurality of liquid droplets therein;
wherein the plurality of liquid droplets comprises a first size upstream of the one or more variable cross-section nozzles and a second size downstream of the one or more variable cross-section nozzles and wherein the second size is smaller than the first size.

19. The wet gas compressor system of claim 18, wherein the one or more variable cross-section nozzles are positioned between a pair of the plurality of stages.

* * * * *